US007059840B2

(12) United States Patent
Corwin et al.

(10) Patent No.: US 7,059,840 B2
(45) Date of Patent: Jun. 13, 2006

(54) ENERGY-SAVING, ANTI-FREE FLOW PORTABLE PUMP FOR USE WITH STANDARD PVC IV TUBING

(75) Inventors: Kenneth J. Corwin, Rochester, NY (US); Roger L. Hungerford, Medina, NY (US); Yuriy Shvetsov, Medina, NY (US); Michael H. Wollowitz, Chatham, NY (US)

(73) Assignee: SIGMA International, Medina, NY (US)

( * ) Notice: Subject to any disclaimer, the term of this patent is extended or adjusted under 35 U.S.C. 154(b) by 0 days.

(21) Appl. No.: 10/117,515

(22) Filed: Apr. 5, 2002

(65) Prior Publication Data

US 2003/0190246 A1 Oct. 9, 2003

(51) Int. Cl.
*F04B 43/08* (2006.01)

(52) U.S. Cl. ..... 417/477.3; 417/479; 417/474; 417/477.12; 604/153; 604/118; 604/285; 604/251

(58) Field of Classification Search ..... 417/479, 417/778, 474, 477.3, 477.12; 604/153, 118–151, 604/285–288.04, 890.1, 89.1, 892.1, 251; 222/153.13, 74, 75
See application file for complete search history.

(56) References Cited

U.S. PATENT DOCUMENTS

| | | | | |
|---|---|---|---|---|
| 1,765,360 | A * | 6/1930 | Baumann | 417/477.12 |
| 2,406,485 | A * | 8/1946 | Arnold | 417/477.13 |
| 2,987,004 | A * | 6/1961 | Murray | 417/477.12 |
| 3,295,556 | A * | 1/1967 | Gertsma et al. | 138/119 |
| 3,875,970 | A * | 4/1975 | Fitter | 138/110 |
| 4,029,441 | A * | 6/1977 | Fischer | 417/477.12 |
| 4,131,399 | A * | 12/1978 | Calvet | 417/477.12 |
| 4,559,038 | A * | 12/1985 | Berg et al. | 604/153 |
| 4,586,882 | A * | 5/1986 | Tseng | 417/477.3 |
| 4,653,987 | A | 3/1987 | Tsuji et al. | |
| 4,688,753 | A * | 8/1987 | Tseng et al. | 251/7 |
| 4,932,629 | A * | 6/1990 | Rodomista et al. | 251/4 |
| 4,952,124 | A * | 8/1990 | Ogami | 417/474 |
| 4,954,055 | A * | 9/1990 | Raible et al. | 417/477.5 |
| 5,067,879 | A * | 11/1991 | Carpenter | 417/477.1 |
| 5,215,450 | A * | 6/1993 | Tamari | 417/474 |
| 5,286,176 | A * | 2/1994 | Bonin | 417/413.1 |
| 5,342,182 | A * | 8/1994 | Montoya et al. | 417/477.1 |
| 5,567,120 | A | 10/1996 | Hungerford et al. | |

(Continued)

FOREIGN PATENT DOCUMENTS

DE 200 03 059 U1 6/2001

(Continued)

OTHER PUBLICATIONS

Partial European Search Report (Oct. 31, 2003) for European patent application No. EP 03 00 7783.

*Primary Examiner*—Timothy S. Thorpe
*Assistant Examiner*—Emmanuel Sayoc
(74) *Attorney, Agent, or Firm*—Simpson & Simpson, PLLC

(57) ABSTRACT

An apparatus for pumping fluid through tubing comprising a stop platen is disclosed. The stop platen is operatively arranged to depress a wall of the tubing along a section of a longitudinal axis of the tubing. The stop platen is narrower than the tubing along a transverse axis of the tubing. The invention further comprises a cabinet containing the stop platen, a door rotatably fixed to the cabinet, and locking means for preventing rotation of the door. The locking means are operatively arranged to be unlocked by a tubing occluder.

9 Claims, 18 Drawing Sheets

U.S. PATENT DOCUMENTS

| | | | | | |
|---|---|---|---|---|---|
| 5,772,409 | A | | 6/1998 | Johnson | |
| 5,791,880 | A | | 8/1998 | Wilson | |
| 5,817,083 | A | * | 10/1998 | Shemesh et al. | 604/416 |
| 5,853,398 | A | * | 12/1998 | Lal et al. | 604/250 |
| 5,868,712 | A | * | 2/1999 | Briggs et al. | 604/153 |
| 5,924,852 | A | * | 7/1999 | Moubayed et al. | 417/474 |
| 5,935,106 | A | * | 8/1999 | Olsen | 604/153 |
| 5,938,413 | A | * | 8/1999 | Makino et al. | 417/474 |
| 5,964,583 | A | * | 10/1999 | Danby | 417/474 |
| 5,980,490 | A | * | 11/1999 | Tsoukalis | 604/151 |
| 5,988,983 | A | | 11/1999 | Furusawa | |
| 6,036,166 | A | * | 3/2000 | Olson | 251/7 |
| RE37,074 | E | * | 2/2001 | Danby et al. | 417/474 |
| 6,234,773 | B1 | * | 5/2001 | Hill et al. | 417/474 |
| 6,267,559 | B1 | | 7/2001 | Mossman et al. | |
| 6,554,589 | B1 | * | 4/2003 | Grapes | 417/477.12 |
| 2003/0138335 | A1 | * | 7/2003 | Doi et al. | 417/477.12 |

FOREIGN PATENT DOCUMENTS

| | | | |
|---|---|---|---|
| FR | 1.401.317 | | 6/1965 |
| JP | 404101087 | A * | 4/1992 |
| WO | WO 9525893 | | 9/1995 |

* cited by examiner

ENERGY-SAVING, ANTI-FREE FLOW PORTABLE PUMP FOR USE WITH STANDARD PVC IV TUBING

FIELD OF THE INVENTION

This invention relates to a pump for providing fluid for injection into a patient. More specifically it relates to a method and apparatus for an ambulatory infusion pump for pumping liquid through standard intravenous (IV) tubing.

BACKGROUND OF THE INVENTION

Infusion pumps for delivering fluid to a patient are well known in the art. Two general categories of infusion pumps known in the art are ambulatory pumps and large volume parenteral (LVP) pumps. These pumps deliver fluid to a patient through tubing at higher accuracies than gravity drip tubing delivery systems.

LVP pumps are relatively large infusion pumps that can provide a fluid to a patient for 24 hours or more on a single battery charge, or indefinitely from an AC power connection. They operate on standard IV polyvinyl chloride (PVC) tubing. This obviates the need for changing IV tubing sets when a decision has been made to change from a drip tubing delivery system to the more accurate infusion pump system. Most available LVP pumps completely collapse the PVC tubing during operation to ensure that there is no free flow to the patient or back flow to the fluid reservoir. This leads to very high power consumption when using standard tubing. Thus, a battery capable of powering the pump for 24 hours is very heavy and bulky. A patient receiving fluid from an LVP pump must stay within reach of a power cord, or push a wheeled stand with the LVP pump and battery mounted on it. In addition, fully collapsing the tubing deforms the tubing. The tubing cross section becomes more elliptical the longer the pump operates on it. Less fluid is discharged from the tubing as the cross section becomes more elliptical, leading to negative flow rate errors. The pump rate accuracy decays proportional to the amount of time an individual tubing set is used to deliver fluid to a patient. An example of an LVP infusion pump is shown in U.S. Pat. No. 4,653,987 (Tsuji et al.).

Ambulatory pumps are smaller infusion pumps that can be attached to a patient's belt, allowing them to move around without a bulky LVP pump. However, there are several drawbacks in comparison to the LVP pump. To reduce the weight to a level where a patient can carry the pump, the size of the battery is reduced considerably. The reduced battery cannot provide the power required to completely collapse standard PVC tubing. Instead, many ambulatory pumps require the use of special dedicated IV sets, or special silicon tubing threaded through a cassette to be inserted into the pump. This specialized equipment increases the cost of using the pumps. Even with special dedicated IV sets or silicon tubing and cassettes, many ambulatory pumps can only provide fluid to a patient for a few hours on a single battery charge. An example of an infusion pump that requires a dedicated IV set is shown in U.S. Pat. No. 5,772,409 (Johnson). An example of an ambulatory infusion pump that requires silicon tubing and cassettes is shown in U.S. Pat. No. 5,791,880 (Wilson).

Another problem with the infusion pumps currently in the art is the danger of free flow of fluid when the tubing is inserted or removed from the pump. An occluder is used to completely collapse the tubing while the tubing is outside the pump. The occluder is disengaged when the tubing is installed in the pump. The tubing is occluded again before the tubing is taken out of the pump. However, there is no means currently in the art to ensure that the tubing is occluded before the tubing is installed into or removed from the pump. Thus, the tubing may accidentally become unoccluded while the tubing is outside the pump, allowing fluid to flow freely to the patient. This overdose of fluid may be harmful or even lethal.

Clearly, then, there is a longfelt need for an ambulatory infusion pump that utilizes standard PVC tubing, operates for approximately 24 hours on one battery charge, and can prevent free flow of fluid into the patient.

SUMMARY OF THE INVENTION

The present invention comprises an apparatus for pumping fluid through tubing comprising a stop platen. The stop platen is operatively arranged to depress a wall of the tubing along a section of a longitudinal axis of the tubing. The stop platen is narrower than the tubing along a transverse axis of the tubing. The invention further comprises a cabinet containing the stop platen, a door rotatably fixed to the cabinet, and locking means for preventing rotation of the door. The locking means are operatively arranged to be unlocked by a tubing occluder.

A general object of the present invention is to provide an ambulatory pump that utilizes standard PVC tubing.

Another object of the present invention is to provide an ambulatory pump with high accuracy, preferably better than ±5% accuracy.

It is a further object to provide an ambulatory pump that can deliver fluid to a patient at a high volume flow rate, for example 500 ml/hour, for at least 24 hours.

It is yet another object to provide an ambulatory pump that prevents the free flow of fluid into the patient when the tubing is installed and removed.

These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE PREFERRED EMBODIMENT

It should be appreciated that, in the detailed description of the invention which follows, like reference numbers on different drawing views are intended to identify identical structural elements of the invention in the respective views.

Figure 1:
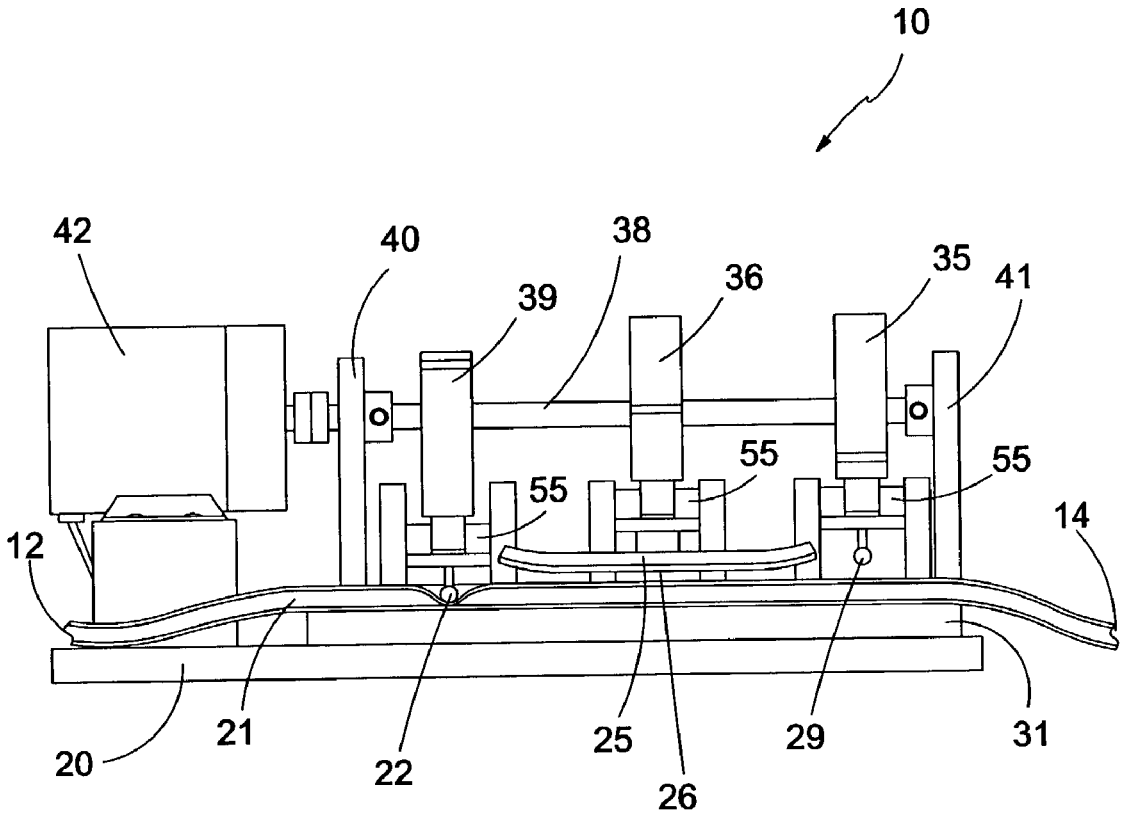
FIG. 1 is a side view of a first embodiment of the present invention, with the platens arranged to allow fluid flow from a reservoir.
Figure 4:
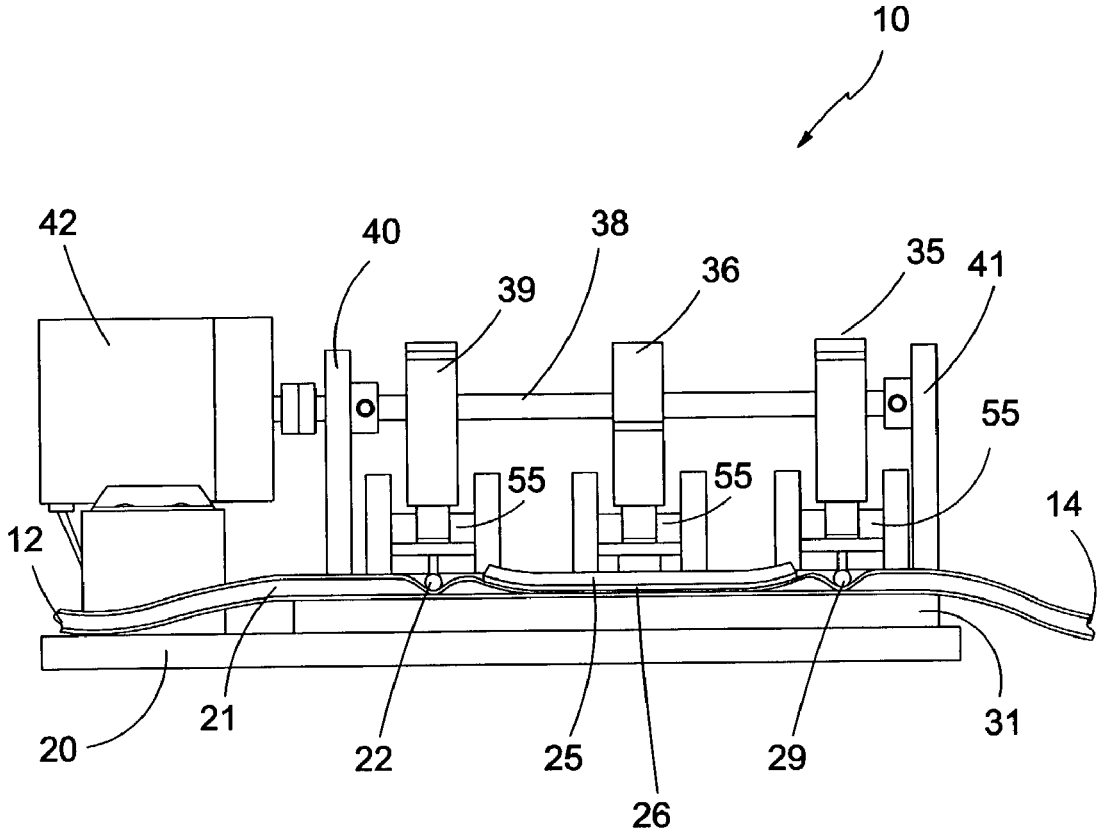
FIG. 4 is a side view of a first embodiment of the present invention, with the platens arranged at the end of a pump cycle.
Figure 5:
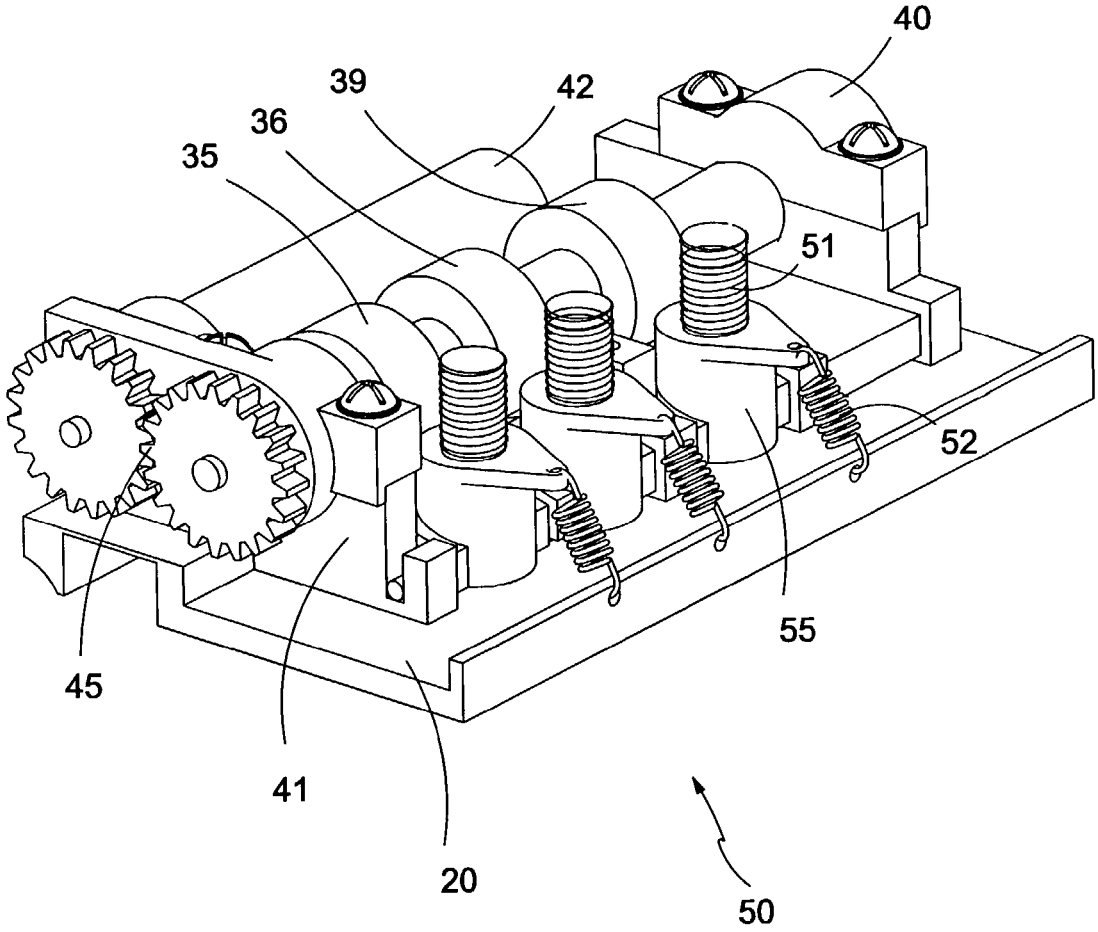
FIG. 5 is a perspective view of the preferred embodiment of the present invention.
Figure 6:
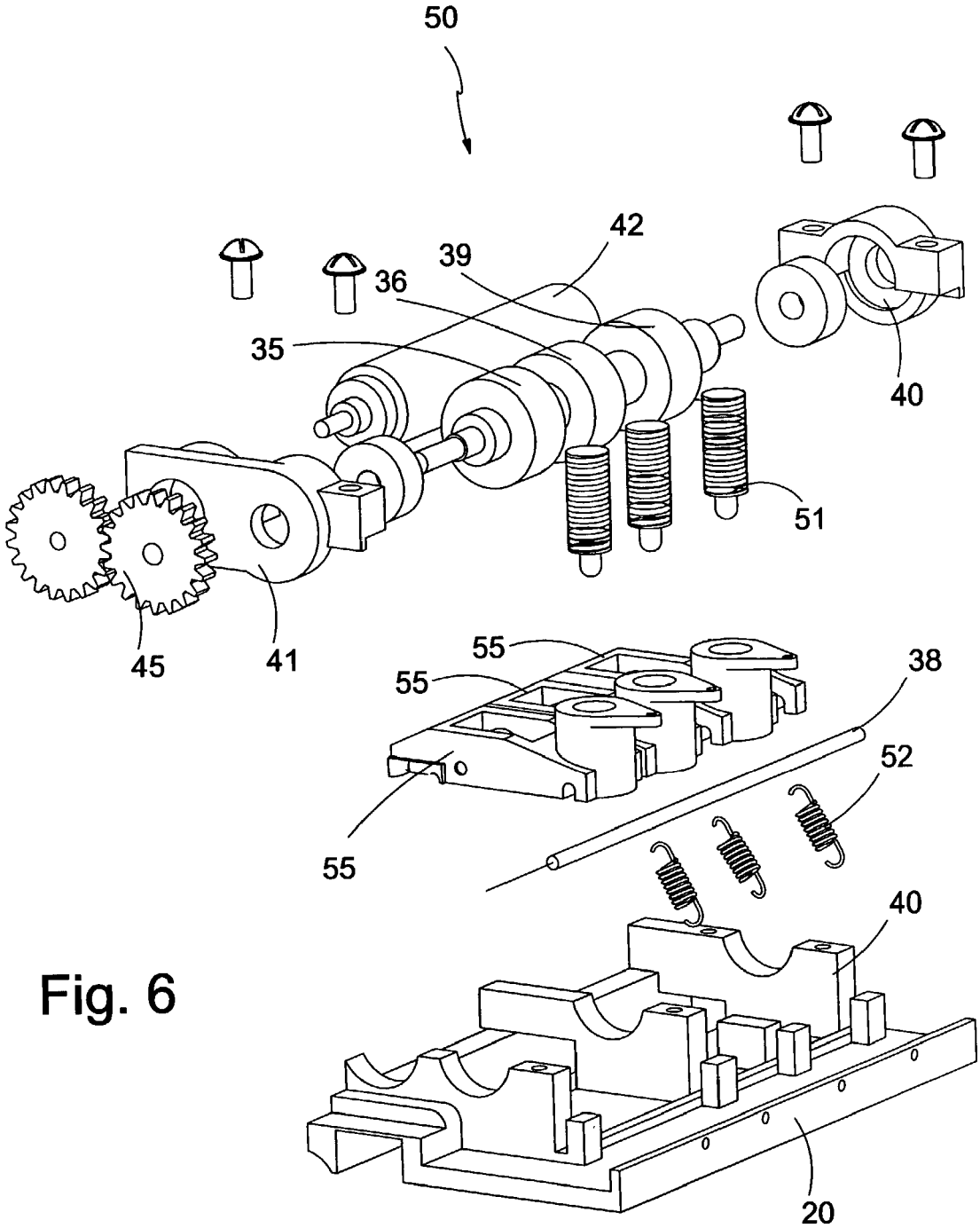
FIG. 6 is an exploded view of the preferred embodiment of the present invention.

A first embodiment of the present invention is shown in FIG. 1 and generally designated 10. Apparatus 10 is an infusion pump comprising pump base 20 with tubing base 31 fixed thereto. Tubing 21 is routed over tubing base 31 underneath occlusion platens 22 and 29, and pump platen 25. Occlusion platen 22 is fixed to platen support 55. Occlusion platen 29 is fixed to platen support 55. Pump platen 25 comprises stop platen 26, and is fixed to platen support 55. Motor 42 is fixed to pump base 20. Motor 42 drives camshaft 38. Camshaft 38 is supported by shaft supports 40 and 41. Cams 35, 36, and 39 are all fixedly mounted on camshaft 38. As camshaft 38 rotates when driven by motor 42, cams 35, 36, and 39 are rotated at the same rate. Cam 35 is operatively arranged to cyclically drive occlusion platen 29 between a first, unoccluding position and a second, occluding position. The first position is shown in FIG. 1, wherein occlusion platen 29 is not in contact with tubing 21. As cam 35 is rotated by shaft 38, platen support 55 is driven down by cam 35. This drives occlusion platen 29 towards tubing 21. Occlusion platen 29 is driven to a second position, shown in FIGS. 2, 3, and 4, where occlusion platen 29 occludes tubing 21. As the shaft continues to rotate, cam 35 moves away from platen support 55. Spring 52, shown on FIGS. 5 and 6, provides upward force on platen support 55 to lift occlusion platen 29 back to the first, unoccluded position. Cam 39 drives occlusion platen 22 through a similar cycle. Occlusion platen 22 is driven from a first, unoccluded position to a second, occluded position. However, occlusion platen 22 occludes tubing 21 at substantially different times than occlusion platen 29. Occlusion platen 22 is shown occluding tubing 21 in FIGS. 1 and 4. Spring 52, shown on FIGS. 5 and 6, provides upward force on platen support 55 to lift occlusion platen 22 back to the first, unoccluded position when cam 39 moves away from platen support 55 due to the rotation of shaft 38.

Figure 2:
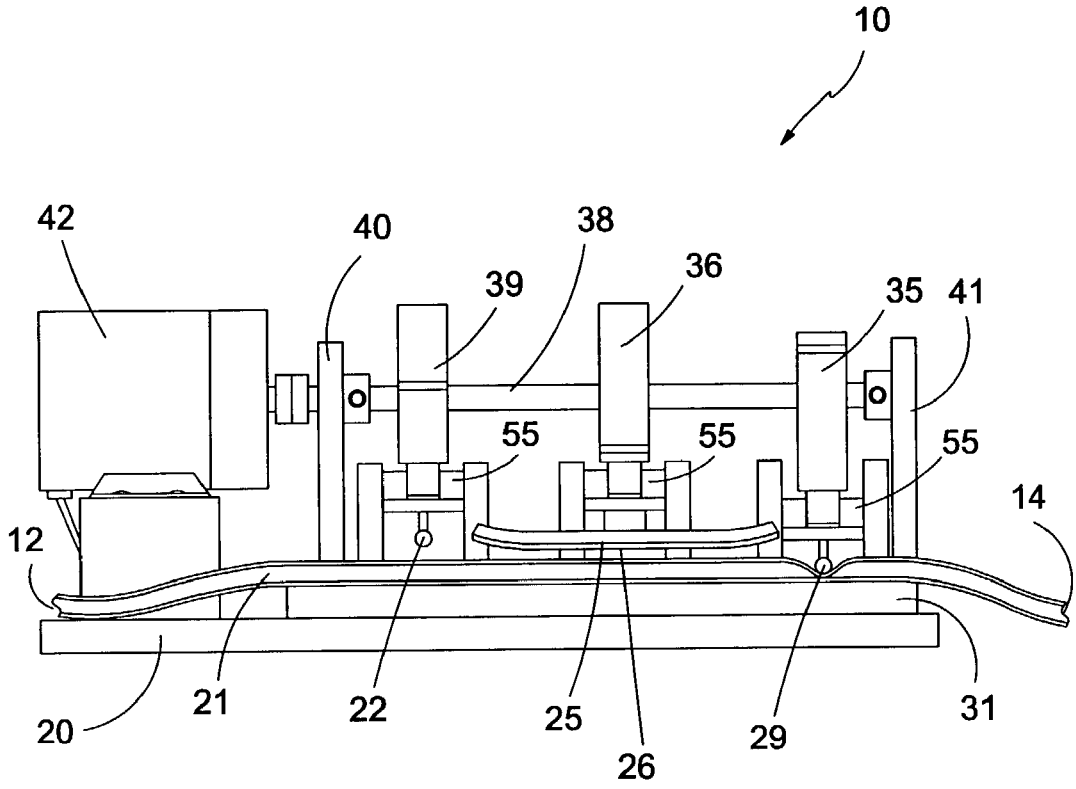
FIG. 2 is a side view of a first embodiment of the present invention, with the platens arranged to allow fluid flow to a patient.
Figure 3:
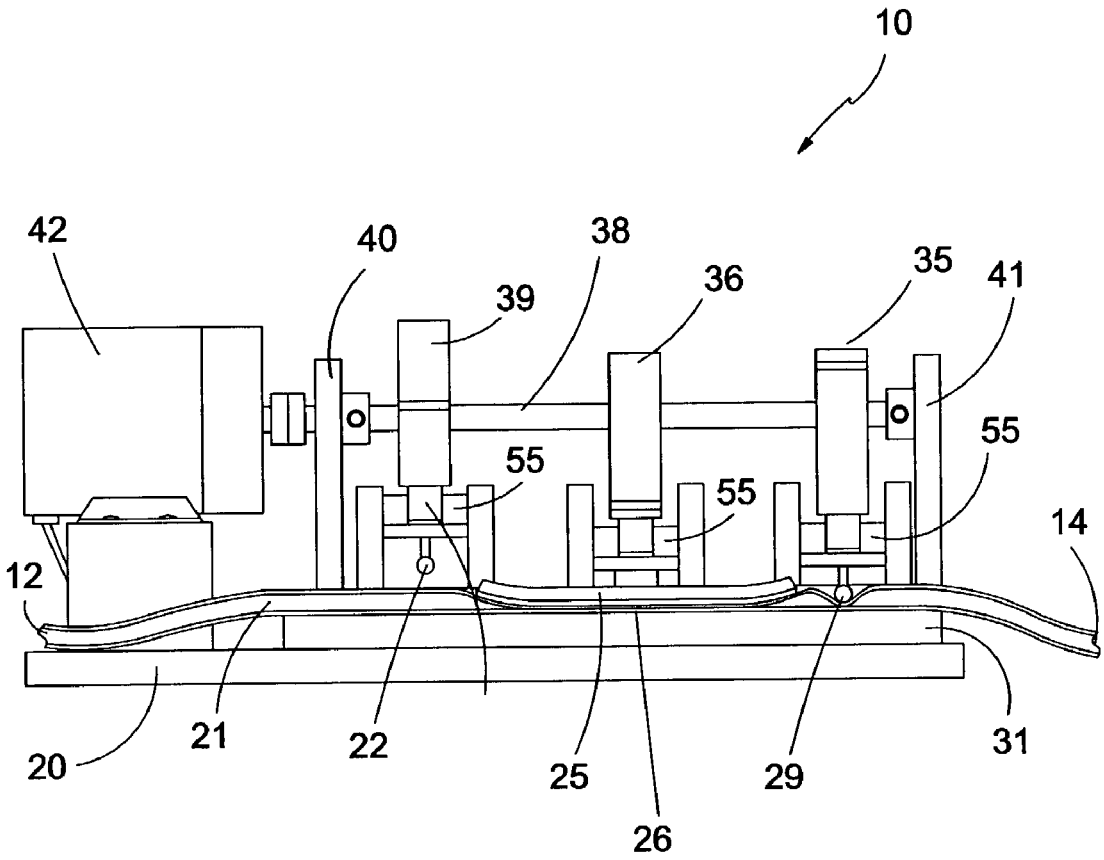
FIG. 3 is a side view of a first embodiment of the present invention, with the platens arranged to pump fluid to a patient.
Figure 4A:
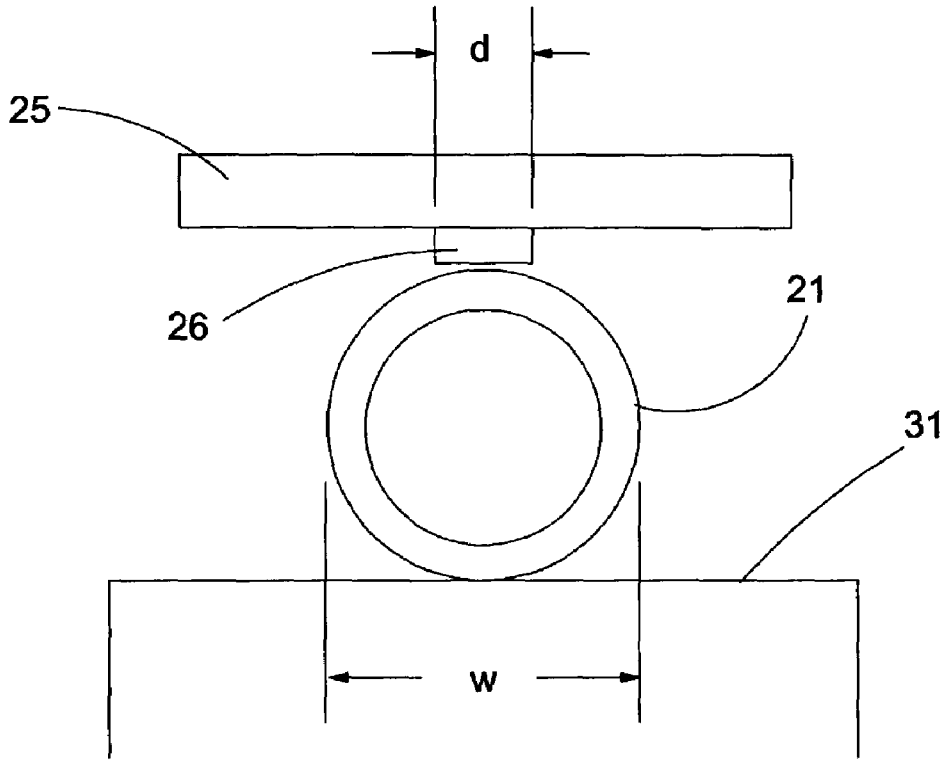
FIG. 4*a* is a cross sectional view of the tubing and the pump platen showing the dimensions of the stop platen and the tubing.
Figure 4B:
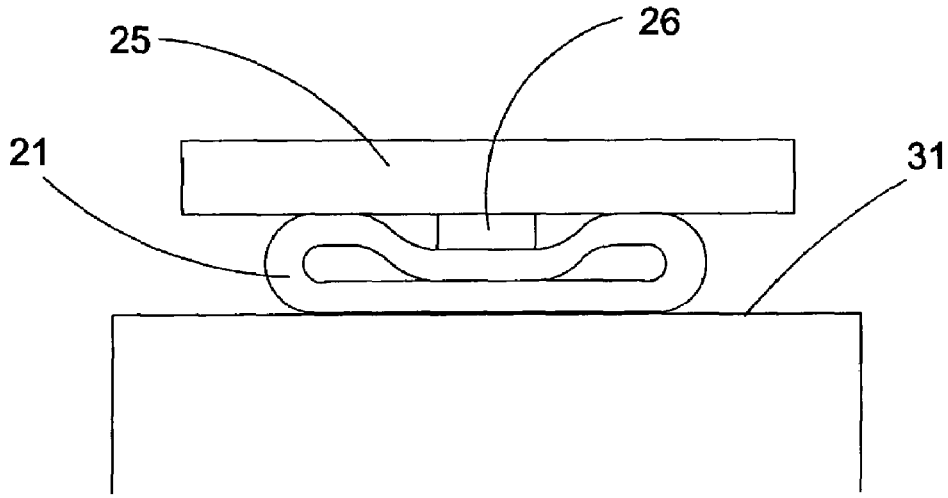
FIG. 4*b* is a cross sectional view of the tubing and the pump platen, with the stop platen completely collapsing a portion of the width of the tubing.

Cam 36 drives pump platen 25 from a first position to a second position as shaft 38 rotates. The first position is shown in FIGS. 1, 2, and 4*a*. The pump platen is not in contact with tubing 21. As shown in FIG. 4*a*, width d of stop platen 26 is less than width w of tubing 21. In FIG. 4*a*, tubing 21 is in a state of rest. That is, tubing 21 is not being compressed by stop platen 26. As shaft 38 rotates, cam 36 drives platen support 55 to a second position, shown in FIGS. 3, 4, and 4*b*. In the second position, pump platen 25 depresses tubing 21. Stop platen 26 completely collapses a section of the width of tubing 21, as shown in FIG. 4*b*. Stop platen 26 prevents pump platen 25 from occluding tubing 21. Stop platen 26 does not occlude tubing 21 because stop platen 26 is narrower than tubing 21, as shown in FIG. 4*a*. Occlusion by the pump platen is undesirable because it would require significantly more power than partially occluding the tubing, as shown in FIGS. 3, 4, and 4*b*. Further, the tubing does not deform as readily when partially deflected by the pump platen, as compared to the deformation caused by occluding the tubing.

In a preferred embodiment, the platens are spring loaded, to allow the platens to be overdriven. This ensures tubing 21 is occluded by the occlusion platens or partially occluded by the stop platen, regardless of the dimension of tubing 21. This improves the accuracy of the pump when using tubing of varying dimensions. Otherwise expensive, complicated measurement devices are needed to ensure that the tubing is deflected the appropriate amount by each platen. Springs 51, shown in FIGS. 5 and 6, accomplish this spring loading.

As shown in FIGS. 1–4, 1*b*, 4*a*, and 4*b*, the preferred embodiment of stop platen 26 is a platen that extends the length of the pump platen, and is centered along the width of the pump platen. However, it should be readily apparent to one skilled in the art that many other configurations of stop platens could be used and these modifications are intended to be within the spirit and scope of the invention as claimed. For example, the stop platen could extend only a portion of the length of the pump platen, or it could be located away from the center of the pump platen. A stop platen shorter than the pump platen could be off center along either the length or width of the pump platen, or both.

FIG. 1 shows platen 22 occluding tubing 21, and platens 25 and 29 above tubing 21. This is the first position in the pump cycle, which allows fluid from a reservoir (not shown) in flow communication with end 14 of tubing 21 to flow into the tubing proximate the pump platen. FIG. 2 shows platen 29 occluding tubing 21, and platens 22 and 25 above tubing 21. This position allows fluid to flow to a patient (not shown) in flow communication with end 12 of tubing 21. FIG. 3 shows platen 29 occluding tubing 21, platen 25 depressing tubing 21 until stop platen 26 completely collapses the central portion of the width of tubing 21, and platen 22 above tubing 21. This configuration forces the fluid in tubing 21 towards end 12 of the tubing. FIG. 4 shows platens 22 and 29 occluding tubing 21, and platen 25 depressing tubing 21 until stop platen 26 completely collapses the central portion of the width of tubing 21. This is the end of the cycle. Platens 25 and 29 move up again to return to the first configuration of the pump cycle shown in FIG. 1.

FIGS. 1–6 show a single pump platen 25. However, it should be readily apparent to one skilled in the art that a plurality of pump platens may be used, and these configurations are intended to be within the spirit and scope of the invention as claimed.

Figure 1A:
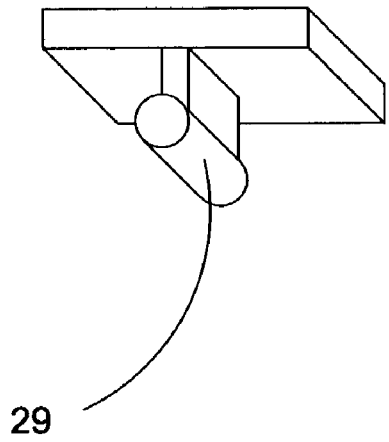
FIG. 1*a* is a perspective view of an occlusion platen.
Figure 1B:
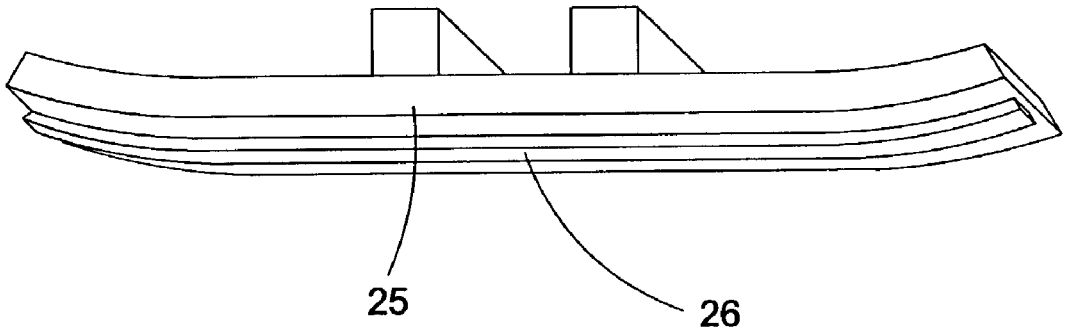
FIG. 1*b* is a perspective view of a pump platen with a stop platen thereon.

FIG. 1*a* is a perspective view of occlusion platen 29. FIG. 1*b* is a perspective view of pump platen 25 with stop platen 26 thereon.

FIG. 5 is a perspective view of the preferred embodiment of the present invention, designated 50. FIGS. 1–4 show motor 42 mounted in line with camshaft 38 so that the platens are visible. To reduce the volume of the pumping assembly, the preferred embodiment locates the motor parallel to the camshaft, coupling them with gears 45 as shown in FIGS. 5 and 6. It should be readily apparent to one skilled in the art that many mechanical configurations are possible, and these modifications are within the spirit and scope of the invention as claimed.

FIG. 6 is an exploded view of the preferred embodiment of the present invention in perspective. Springs 52 provide an upward force on the platen supports to return them to an upper position when each cam moves away from the platen supports. Springs 52 are connected between the platen supports and the pump base 20. Springs 51 spring load the platens so that they may be overdriven. This enables the pump to be used with tubes of differing dimensions, as discussed above.

Figure 7:
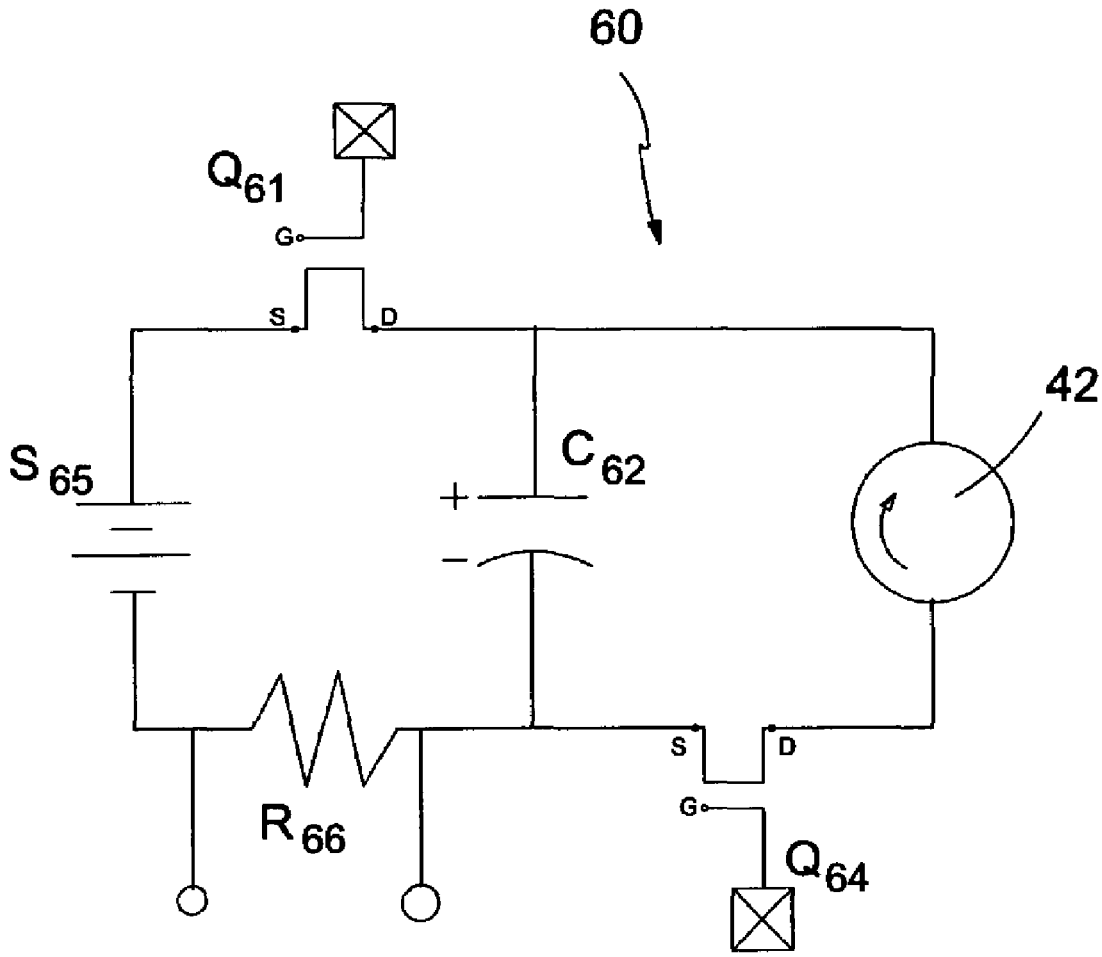
FIG. 7 is an electrical schematic of the motor drive circuit of the preferred embodiment of the present invention.

FIG. 7 is an electrical schematic of the preferred embodiment of the pump. Circuit 60 shown in FIG. 7 is designed to provide power to motor 63 (corresponding to motor 42 of FIGS. 1–6) to pump the fluid over a wide range of flow rates at high accuracy. In a preferred embodiment, the pump will deliver 0.1–500 ml/hr±2%. This is achieved at a low rate, for example, one revolution per hour, by the following process. N-type field effect transistor (FET) 64 is turned off and P-type FET 61 is turned on, charging capacitor 62. P-type FET 61 is then turned off. Capacitor 62 is discharged through motor 63 by turning on N-type FET 64. This discharge process allows a small motor movement. The amount of energy in capacitor 62 is controlled by the amount of time P-type FET 61 is turned on. This process is repeated to pump fluid through the tubing at the desired low rate.

For pumping at a high rate, for example, one revolution per second, P-type FET 61 is turned on and N-type FET 64 pulse width modulates motor 63 with a variable duty cycle. The motor has an average input power based on the duty cycle. The variable power allows higher speed positioning within the tolerances allowed. Power supply 65 is the battery. In a preferred embodiment, capacitor 62 is a 470 μF capacitor, and resistor 66 is 0.1 ohms.

Figure 8:
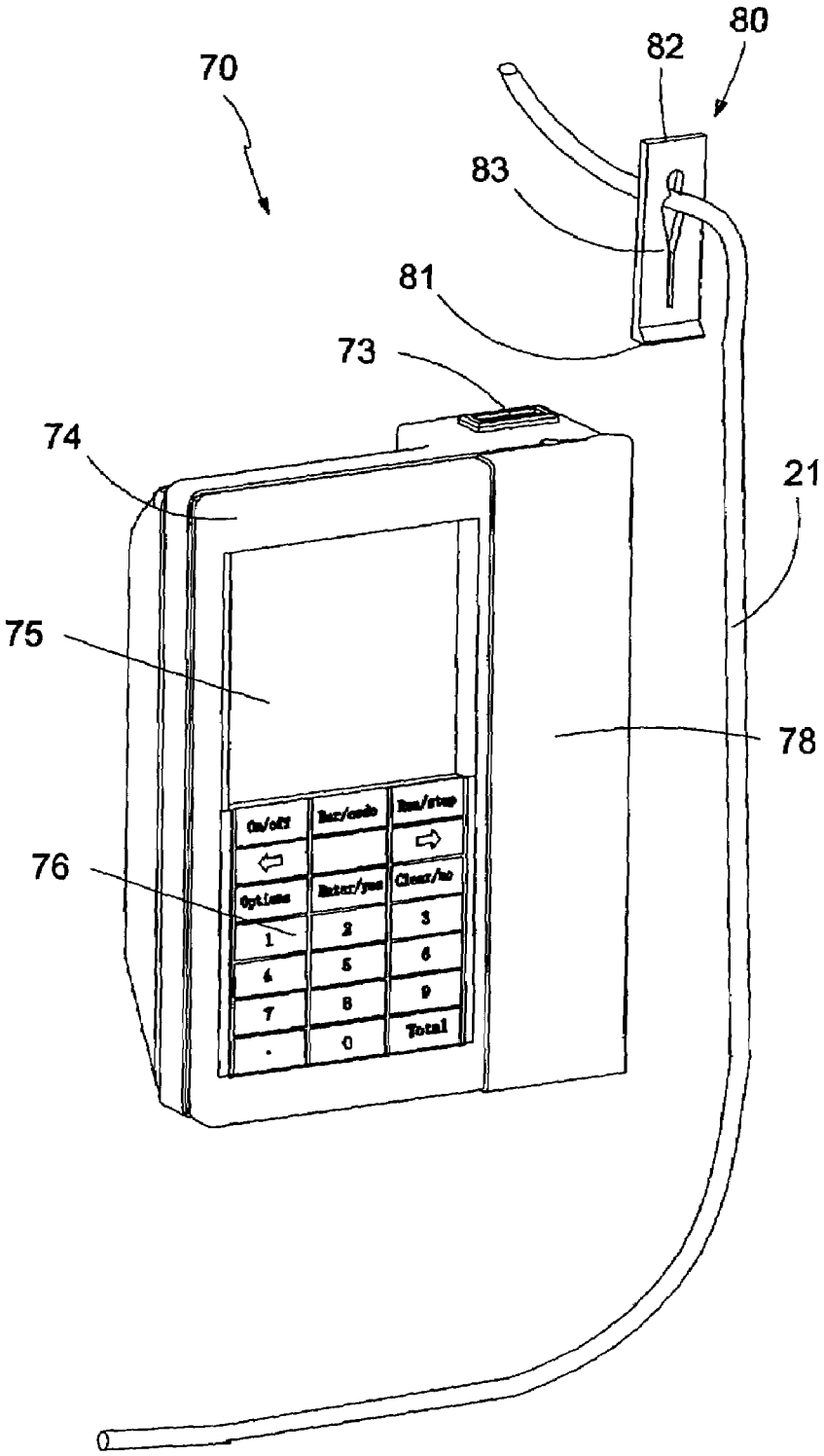
FIG. 8 is a front perspective view of the preferred embodiment of the present invention, a section of tubing, and an occluder, with the door of the present invention closed, and the tubing unoccluded.

In the preferred embodiment, pump assembly 50 is mounted in cabinet 70, as shown in FIGS. 8–16. Cabinet 70 comprises keyhole 73, case 74, display 75, keypad 76, and door 78. Also shown in FIG. 8 is tubing 21 with an occluder 80. Occluder 80 has a first end 81, a second end 82, and a slit 83. To occlude tubing 21, tubing 21 is routed through slit 83 proximate first end 81. Slit 83 is narrowest where the slit is closest to end 81. Slit 83 is wider proximate second end 82. Fluid flows freely through tubing 21 when the tubing is located proximate second end 82. Thus, tubing 21 is shown unoccluded in FIG. 8. Fluid may flow freely through the tubing to a patient.

Figure 9:
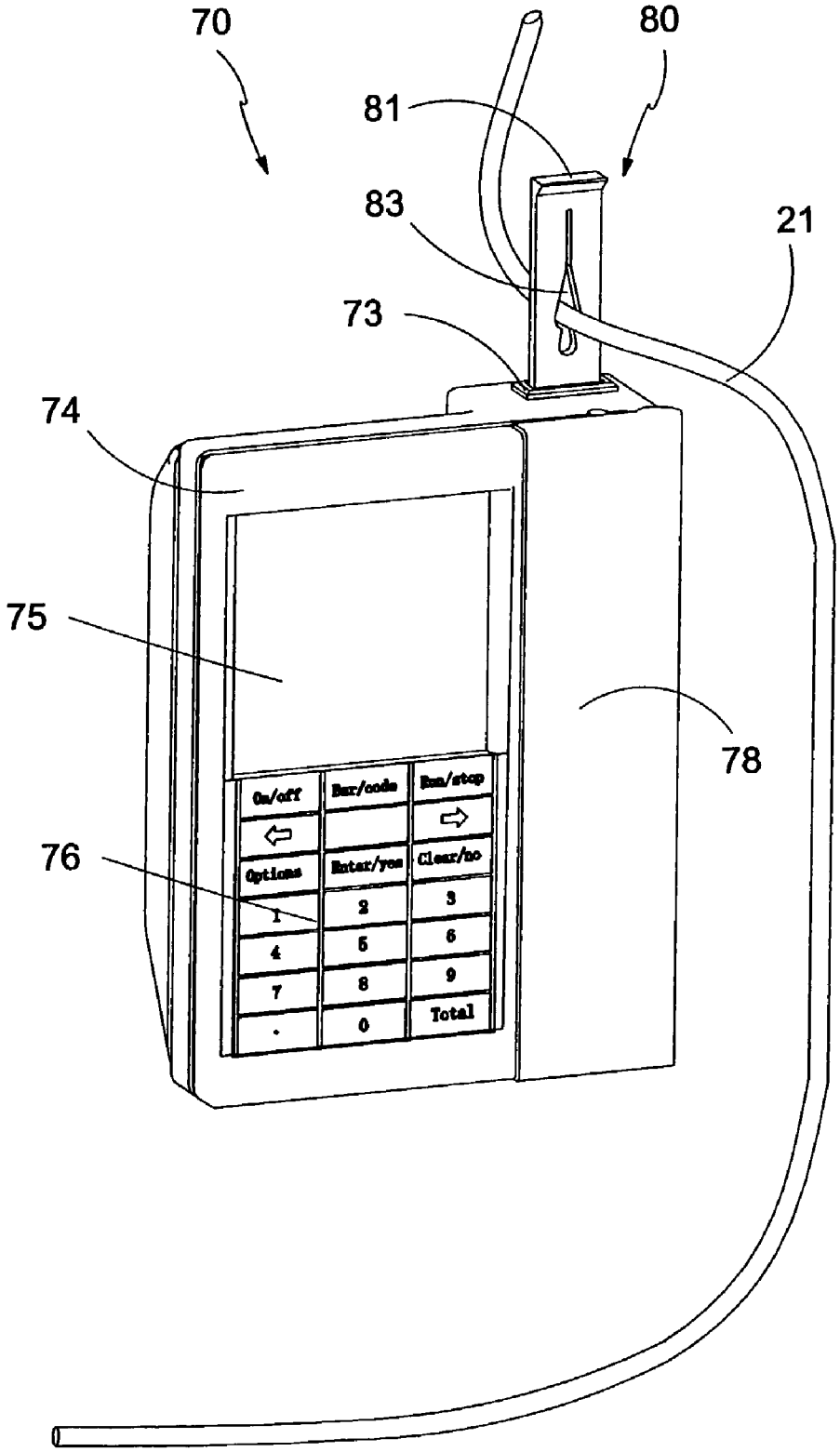
FIG. 9 is a front perspective view of the preferred embodiment of the present invention, a section of tubing, and an occluder, with the door of the present invention closed, and the occluder being inserted in the keyhole of the present invention.
Figure 10:
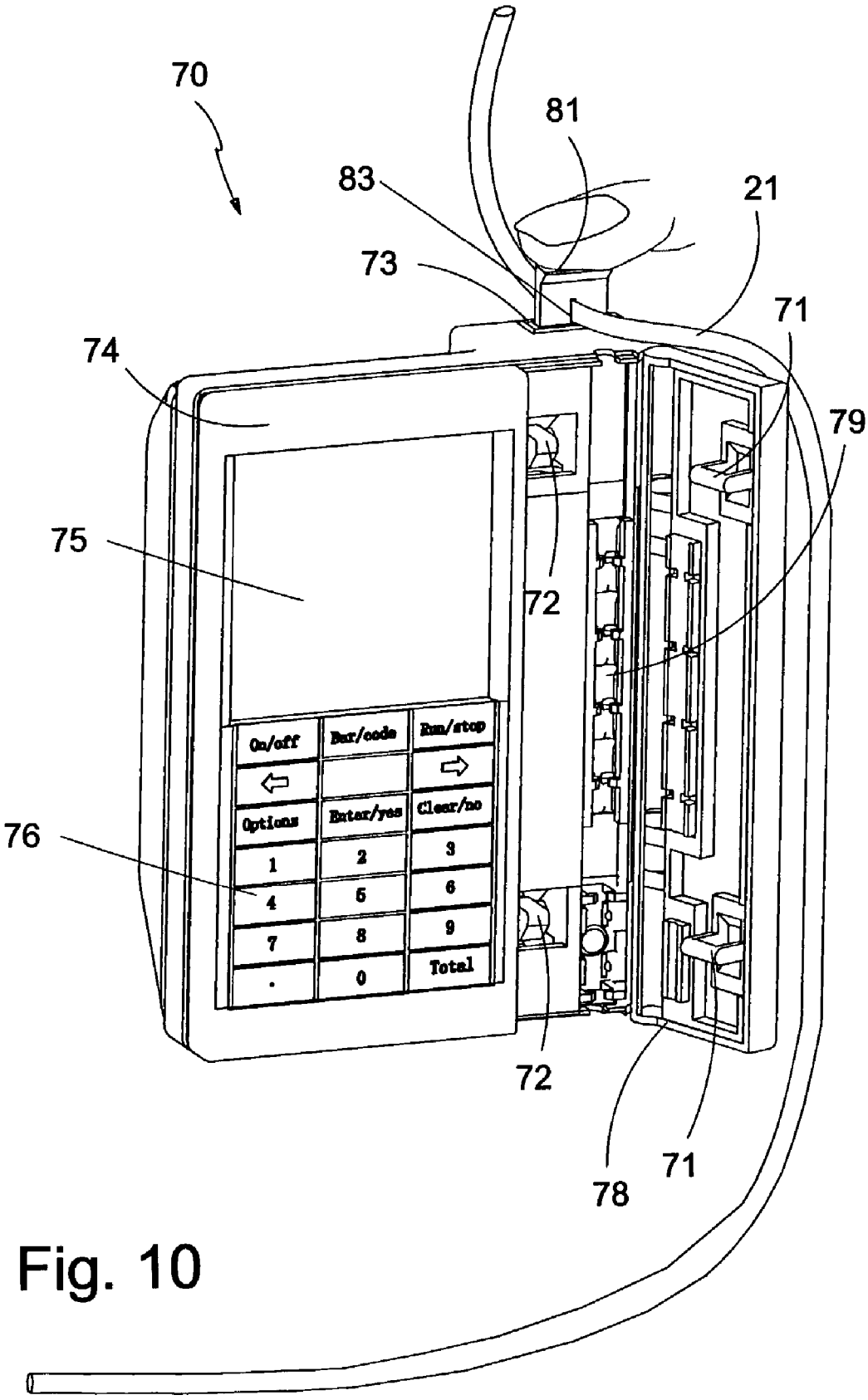
FIG. 10 is a front perspective view of the preferred embodiment of the present invention, a section of tubing, and an occluder, with the door of the present invention open.
Figure 11:
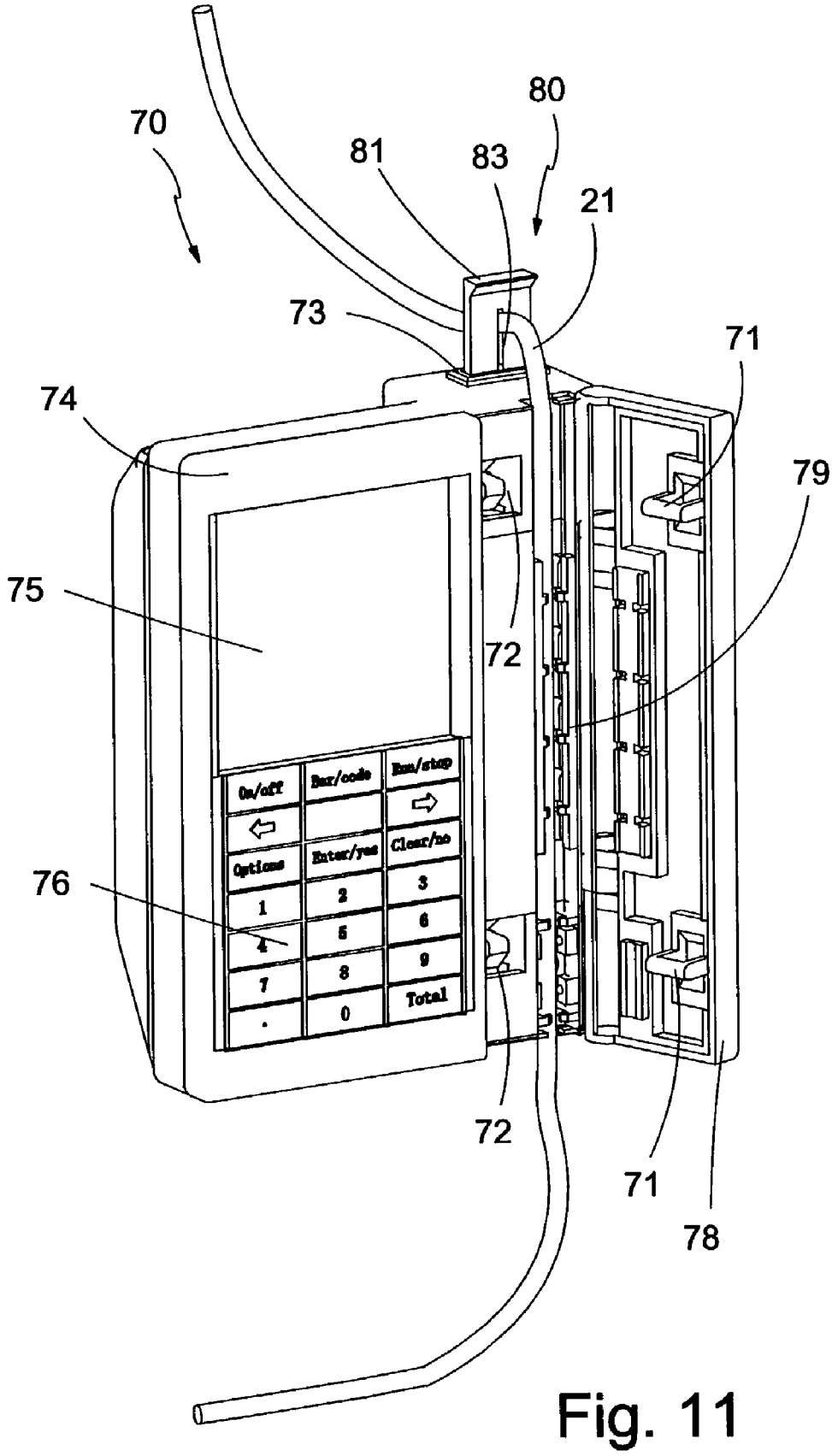
FIG. 11 is a front perspective view of the preferred embodiment of the present invention, a section of tubing, and an occluder, with the door of the present invention open, and the tubing installed in the pump.
Figure 12:
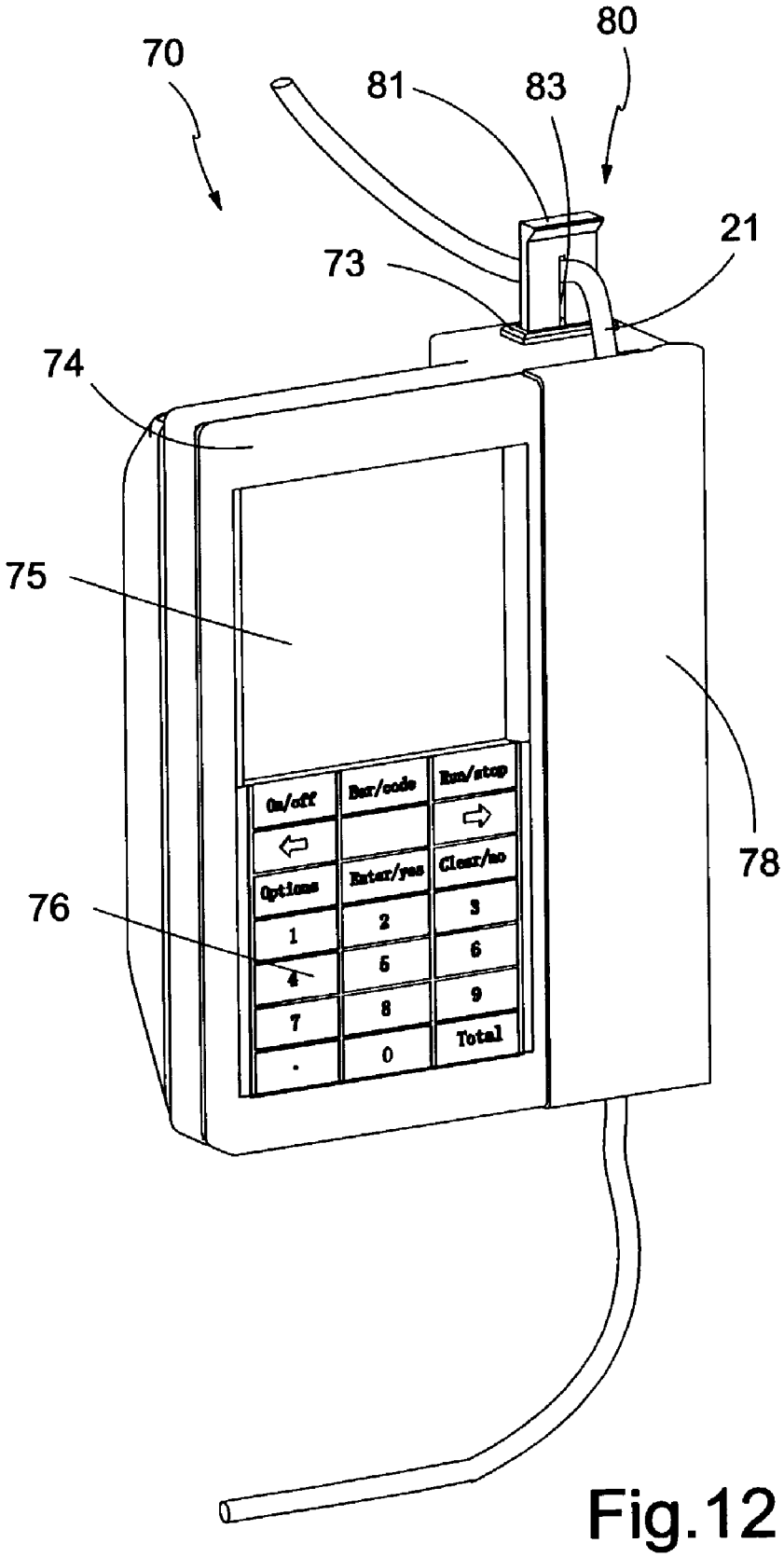
FIG. 12 is a front perspective view of the preferred embodiment of the present invention, a section of tubing, and an occluder, with the door of the present invention closed, and the tubing installed in the pump.
Figure 13:
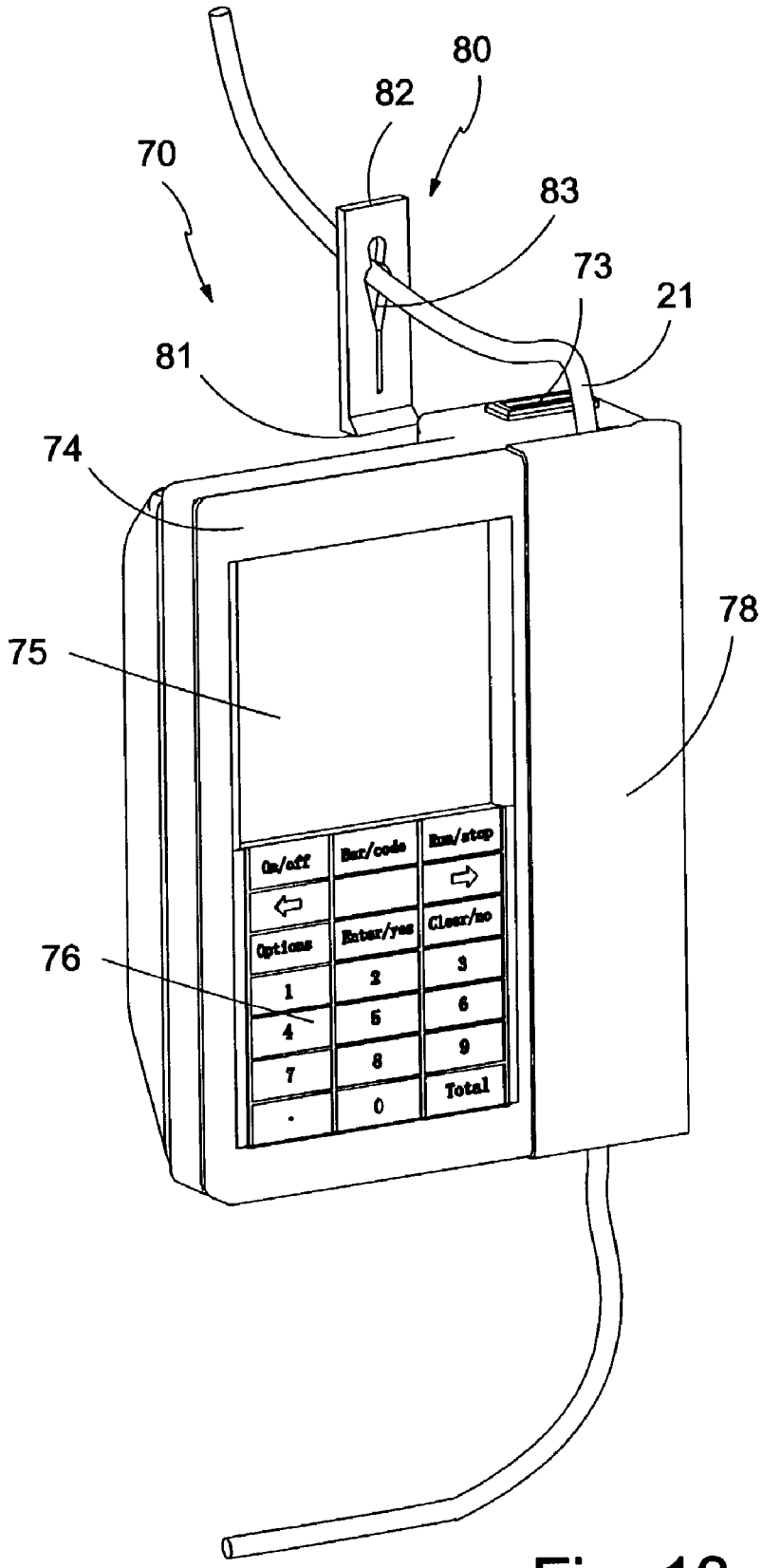
FIG. 13 is a front perspective view of the preferred embodiment of the present arranged to pump fluid through the tubing.

Free flow of fluid through the tubing is prevented with the present apparatus as follows. FIG. 9 shows occluder 80 being inserted into slot 73 of the present invention. Second end 82 must be inserted to open door 78, as first end 81 is too thick to fit into keyhole 73. As occluder 80 is inserted into keyhole 73, tubing 21 is forced towards first end 81, as shown in FIG. 10. Thus to open door 79, tubing 21 must be occluded by occluder 80. Door 78 unlocks as shown in FIG. 10, exposing the pump assembly. Door 78 is unlocked when hooks 72 disengage loops 71. Tubing 21 is routed along tubing channel 79, between the tubing base and the platens, as shown in FIG. 11. Door 78 is closed, as shown in FIG. 12. Occluder 80 is removed from keyhole 73, and tubing 21 is moved through slot 83 until it is unoccluded. This is shown in FIG. 13. The pump may now operate to deliver fluid to a patient.

Figure 14:
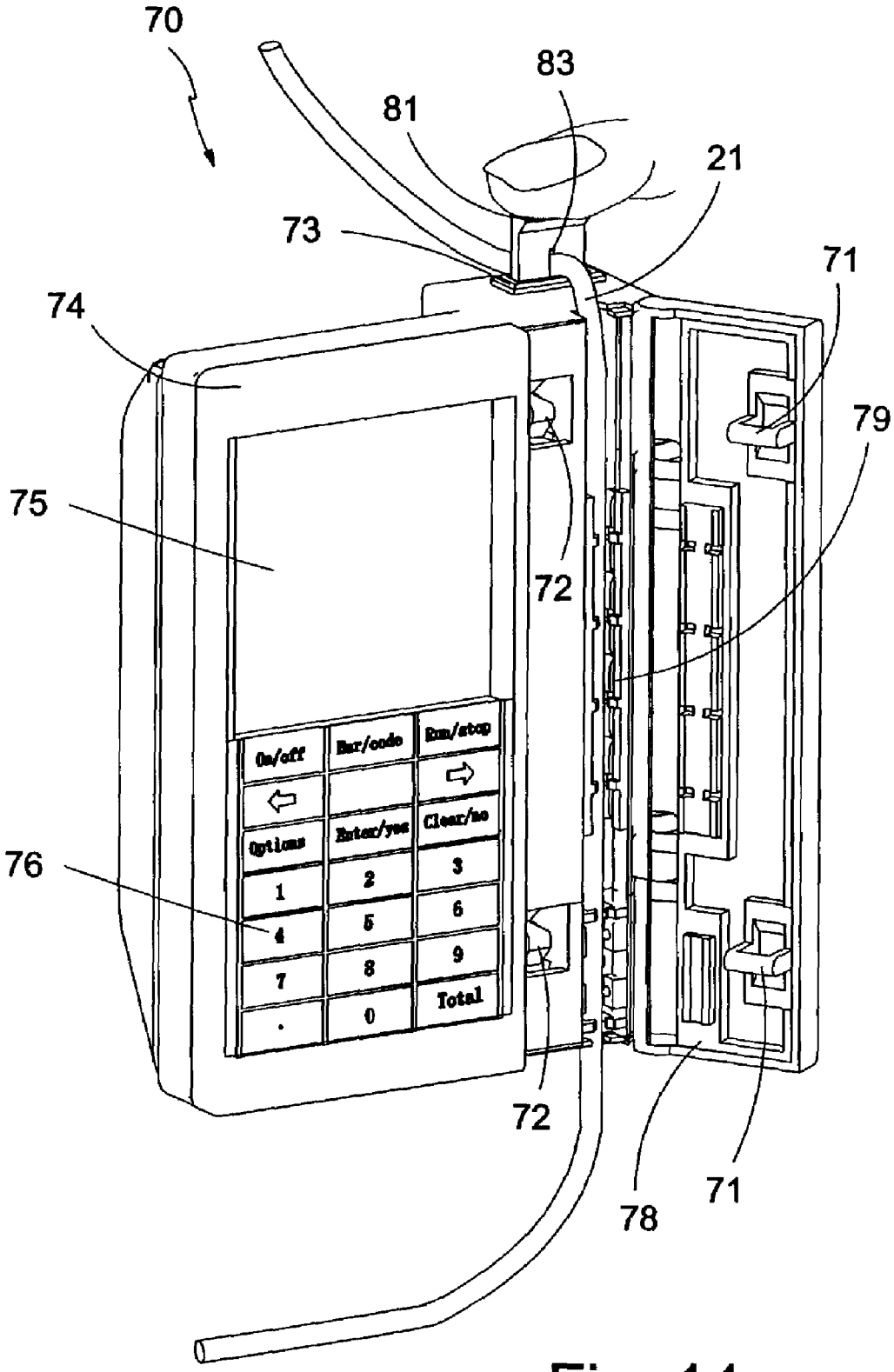
FIG. 14 is a front perspective view of the preferred embodiment of the present invention, a section of tubing, and an occluder, with the door of the present invention opened, and the tubing installed in the pump.
Figure 15:
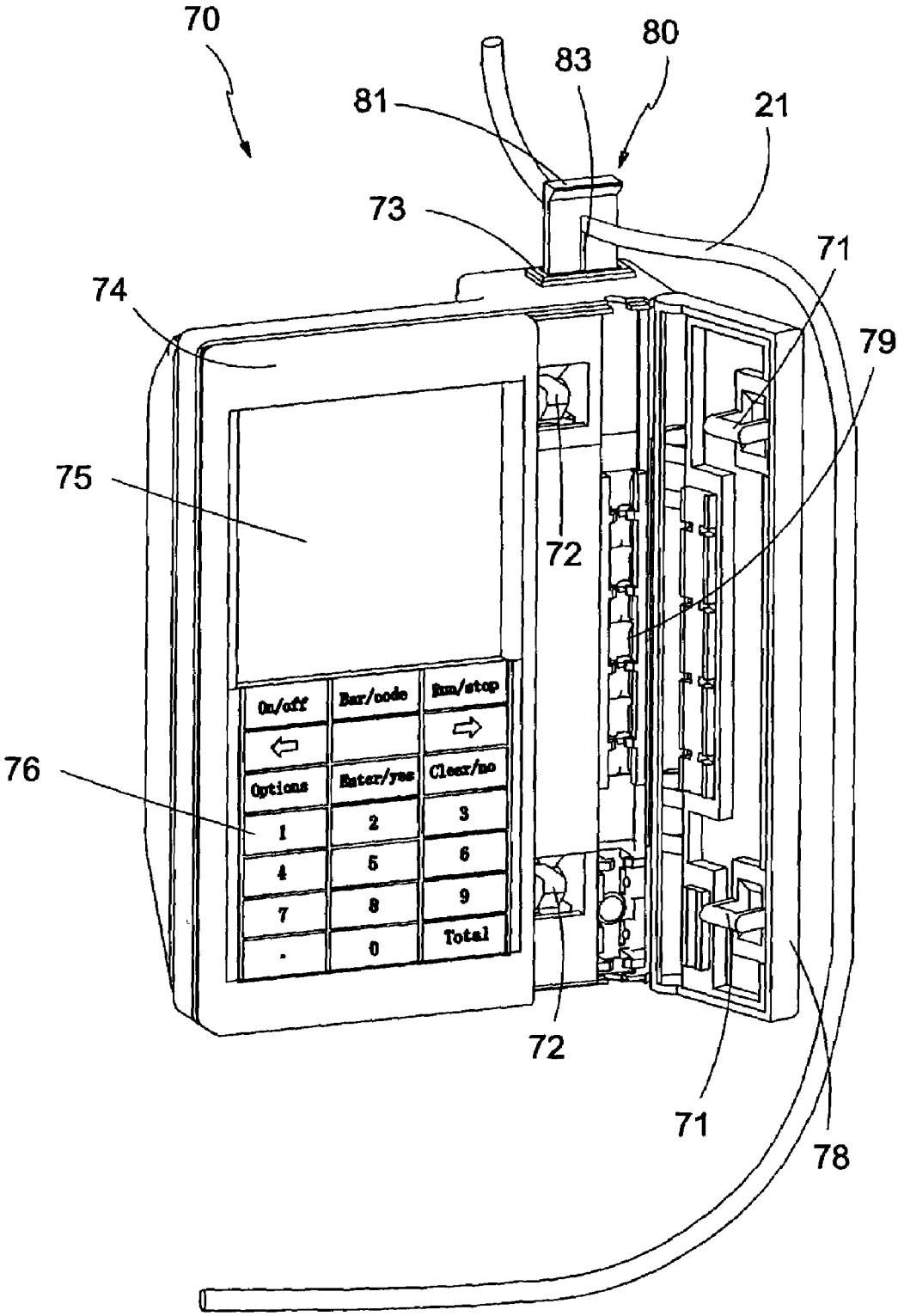
FIG. 15 is a front perspective view of the preferred embodiment of the present invention, a section of tubing, and an occluder, with the door of the present invention open, and the tubing uninstalled from the pump.
Figure 16:
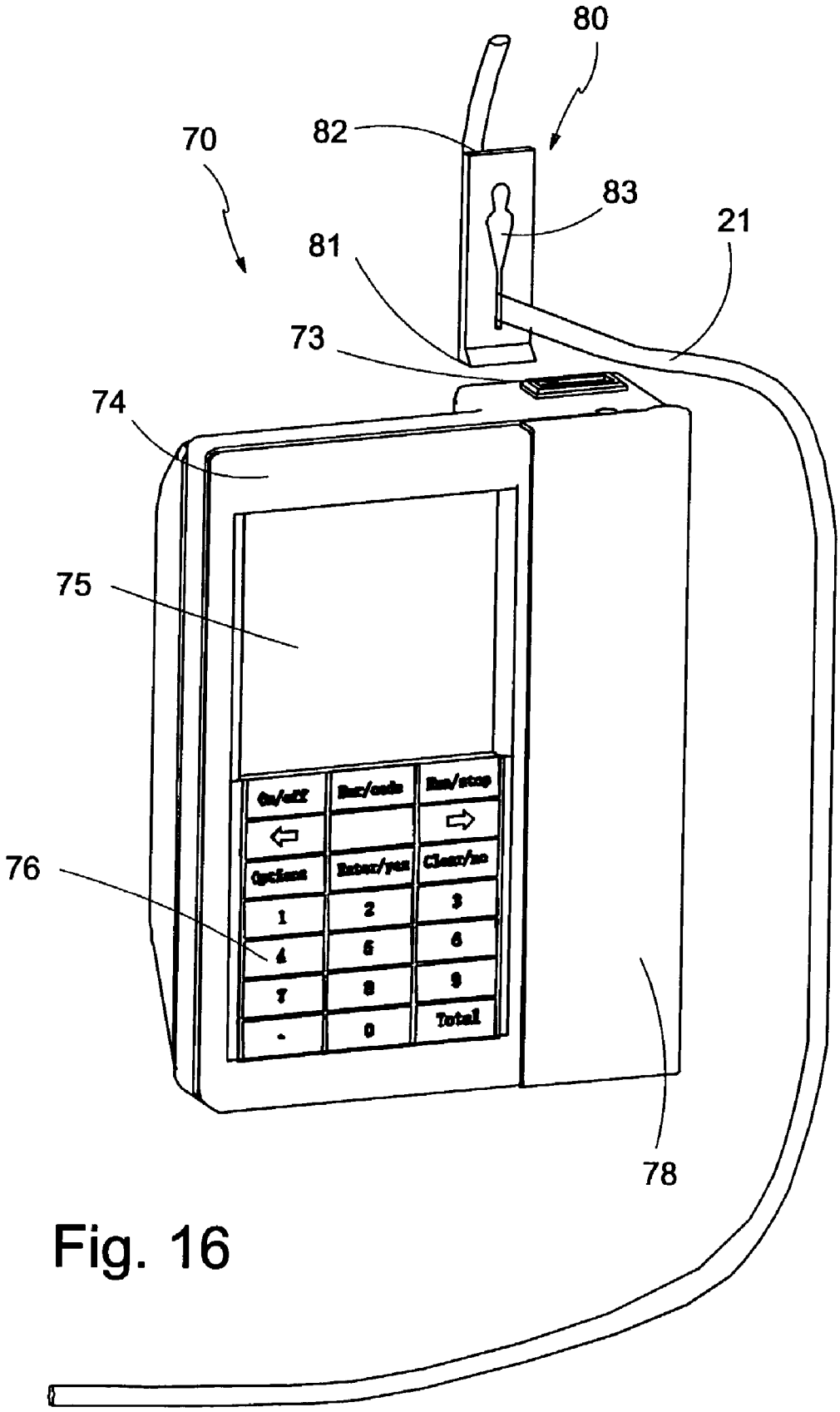
FIG. 16 is a front perspective view of the preferred embodiment of the present invention, a section of tubing, and an occluder, with the door of the present invention closed, and the tubing occluded.

To remove the tubing from cabinet 70, occluder 80 is again inserted in keyhole 73. This forces tubing 21 to first end 81, occluding the tubing. Door 78 opens, as shown in FIG. 14. The tubing is removed from the pump in FIG. 15. FIG. 16 shows the tubing outside the pump and pump door 78 closed. Tubing 21 is still occluded. In the above-described manner, the present invention requires the tubing to be occluded before the door can be opened. This will prevent medical personnel from forgetting to occlude the tubing before it is removed from the pump.

Thus, it is seen that the objects of the present invention are efficiently obtained, although modifications and changes to the invention should be readily apparent to those having ordinary skill in the art, and these modifications are intended to be within the spirit and scope of the invention as claimed.

What is claimed is:

1. An infusion pump comprising:

a tubing base for said infusion pump having a continuous tubing support surface;

a stop platen, for said infusion pump, said stop platen operatively arranged to depress a wall of said tubing along a section of a longitudinal axis of said tubing to induce pumping, wherein said tubing is closed to the atmosphere and has a normally circular cross-section and a wall of uniform thickness, said stop platen is narrower than said tubing along a transverse axis, measured with said tubing uncompressed, wherein said stop platen being sufficiently narrow so that pressing said stop platen against said tubing will not completely occlude said tubing;

first and second occlusion platens; and, actuation means for moving said stop platen to depress said wall of said tubing.

2. The apparatus recited in claim 1 wherein said stop platen is centered with respect to said tubing along said transverse axis of said tubing.

3. The apparatus recited in claim 1 wherein said actuation means comprises a cam fixedly located on a camshaft, said camshaft operatively arranged to be rotated by a motor.

4. The apparatus recited in claim 1 further comprising means to constrain said tubing to remain proximate said stop platen.

5. The apparatus recited in claim 4 wherein said constraining means comprises:

a cabinet containing said stop platen;

a door rotatably fixed to said cabinet; and, locking means for preventing rotation of said door.

6. The apparatus recited in claim 5 wherein said locking means comprises a latch, said latch operatively arranged to be unlatched by a tubing occluder.

7. The apparatus recited in claim 6 wherein said latch is operatively arranged to be unlatched by a first end of said tubing occluder, wherein said tubing occluder is operatively arranged to occlude said tubing when said tubing is located proximate a second end of said tubing occluder.

8. An apparatus for preventing the free flow of fluid in tubing installed in a pump comprising:

a cabinet containing said pump;

a door rotatably fixed to said cabinet; and, locking means for preventing rotation of said door, said means operatively arranged to prevent rotation of said door responsive to a position of a tubing occluder.

9. The apparatus recited in claim 8 wherein said locking means comprises a latch, said latch operatively arranged to be unlatched by a first end of said tubing occluder, wherein said tubing occluder is operatively arranged to occlude said tubing when said tubing is located proximate a second end of said tubing occluder.

* * * * *